US010842333B2

(12) United States Patent
Koetz

(10) Patent No.: US 10,842,333 B2
(45) Date of Patent: Nov. 24, 2020

(54) SYSTEM AND METHOD FOR CLEANING A FLOOR USING A CLEANING ROBOT

(71) Applicant: Vorwerk & Co. Interholding GmbH, Wuppertal (DE)

(72) Inventor: Hendrik Koetz, Wetter (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 0 days.

(21) Appl. No.: 16/098,947

(22) PCT Filed: May 9, 2017

(86) PCT No.: PCT/EP2017/060999
§ 371 (c)(1),
(2) Date: Nov. 5, 2018

(87) PCT Pub. No.: WO2017/194505
PCT Pub. Date: Nov. 16, 2017

(65) Prior Publication Data

US 2019/0082918 A1 Mar. 21, 2019

(30) Foreign Application Priority Data

May 9, 2016 (DE) ..... 10 2016 108 513

(51) Int. Cl.
*A47L 9/28* (2006.01)

(52) U.S. Cl.
CPC ..... *A47L 9/2805* (2013.01); *A47L 9/2836* (2013.01); *A47L 9/2894* (2013.01); *A47L 2201/06* (2013.01)

(58) Field of Classification Search
CPC .... A47L 9/2805; A47L 9/2836; A47L 9/2894; A47L 2201/06; A47L 9/28; A47L 9/30;
(Continued)

(56) References Cited

U.S. PATENT DOCUMENTS 6,459,955 B1 * 10/2002 Bartsch ..... A47L 9/00 700/245
7,133,746 B2 * 11/2006 Abramson ..... G05D 1/0225 700/259

(Continued)

FOREIGN PATENT DOCUMENTS

CN 1665438 A 9/2005
CN 1305427 C 3/2007

(Continued)

OTHER PUBLICATIONS

Ishida et al., Chemical Sensing in Robotic Applications: A Review, 2012, IEEE, p. 3163-3173 (Year: 2012).*

(Continued)

*Primary Examiner* — McDieunel Marc
(74) *Attorney, Agent, or Firm* — The Webb Law Firm

(57) ABSTRACT

A system for cleaning a floor by means of at least one cleaning robot, which cleaning robot comprises control means for controlling the cleaning robot and communication means for sensing at least one event having increased soiling emergence of at least part of the floor, wherein the control means set the intensity of the use of the cleaning robot for cleaning at least part of the floor in accordance with the intensity of at least one event having increased soiling emergence. The system solves the technical problem of making a system and a method for cleaning a floor by means of a cleaning robot more flexible and enabling improved cleaning results. The system further relates to a method for cleaning a floor.

14 Claims, 2 Drawing Sheets

(58) Field of Classification Search

CPC ..... B25J 9/1679; B25J 9/163; G05D 1/0274; G05D 1/0219; G01C 21/206; E01H 1/00; G06Q 50/02; A01B 79/005; A01B 79/02; A01B 49/06; A01B 69/008; A01B 39/06; A01B 47/00; A01B 49/04; A01B 51/02; A01B 63/008; G06N 3/08; A01C 5/064; G06F 16/29; G01W 1/14; G01W 2201/00; G05B 13/048; G05B 19/0421; C05G 3/80; H04W 4/38; H02S 40/10; B08B 1/002; Y10S 71/903

See application file for complete search history.

(56) References Cited

U.S. PATENT DOCUMENTS

| | | | | |
|---|---|---|---|---|
| 7,389,156 | B2 * | 6/2008 | Ziegler | A22C 17/0013 318/568.1 |
| 7,574,282 | B2 * | 8/2009 | Petersson | A01D 34/008 180/167 |
| 7,620,476 | B2 * | 11/2009 | Morse | A47L 5/14 15/319 |
| 8,046,103 | B2 * | 10/2011 | Abramson | A01D 34/008 367/103 |
| 9,629,514 | B2 * | 4/2017 | Hillen | A47L 9/30 |
| 2005/0150519 | A1 | 7/2005 | Keppler et al. | |
| 2007/0148725 | A1 * | 6/2007 | Hashimoto | C12Q 1/02 435/34 |
| 2012/0158915 | A1 | 6/2012 | Ham et al. | |
| 2014/0207280 | A1 | 7/2014 | Duffley et al. | |
| 2015/0032260 | A1 * | 1/2015 | Yoon | A47L 9/2857 700/257 |
| 2015/0212520 | A1 * | 7/2015 | Artes | G05D 1/0219 701/2 |
| 2016/0071223 | A1 * | 3/2016 | Rupp | A01D 41/1274 705/7.11 |
| 2016/0232621 | A1 * | 8/2016 | Ethington | G06Q 50/02 |
| 2017/0265703 | A1 | 9/2017 | Park et al. | |
| 2017/0312916 | A1 * | 11/2017 | Williams | G01C 21/206 |
| 2018/0307253 | A1 * | 10/2018 | Weiler | G05D 7/0617 |
| 2018/0360285 | A1 * | 12/2018 | Erkek | A47L 9/28 |
| 2018/0361577 | A1 * | 12/2018 | Williams | E01H 1/00 |
| 2018/0361581 | A1 * | 12/2018 | Williams | B25J 9/163 |
| 2018/0361583 | A1 * | 12/2018 | Williams | G05D 1/0274 |
| 2018/0361584 | A1 * | 12/2018 | Williams | B25J 9/1679 |
| 2018/0361585 | A1 * | 12/2018 | Williams | B25J 9/1679 |

FOREIGN PATENT DOCUMENTS

| | | | |
|---|---|---|---|
| EP | 1711873 | B1 | 12/2012 |
| WO | 2014056443 | A1 | 4/2014 |
| WO | 2015199197 | A1 | 12/2015 |
| WO | 2016027957 | A1 | 2/2016 |

OTHER PUBLICATIONS

Milinda et al., Mud and dirt separation method for floor cleaning robot, 2017, IEEE, p. 316-320 (Year: 2017).*

Palacin et al., Measuring Coverage Performances of a Floor Cleaning Mobile Robot Using a Vision System, 2005, IEEE, p. 4236-4241 (Year: 2005).*

Oh et al., Development of small robot for home floor cleaning, 2002, IEEE, p. 3222-3223 (Year: 2002).*

Hong et al., Mopping module design and experiments of a multi-function floor cleaning robot, 2014, IEEE, p. 5097-5102 (Year: 2014).*

Palacin et al., Building a mobile robot for a floor-cleaning operation in domestic environments, 2004, IEEE, p. 1418-1424 (Year: 2004).*

Bawden et al., A Lightweight Modular Robotic Vehicle for thye Sustainable Intensification of Agriculture, 2014, IEEE, Internet p. 1-9 (Year: 2014).*

Bawden et al., Design of a Lightweight, Modular Robotic Vehicle for the Sustainable Intensification of Broadacre Agriculture, 2015, Internet p. 1-164 (Year: 2015).*

* cited by examiner

SYSTEM AND METHOD FOR CLEANING A FLOOR USING A CLEANING ROBOT

CROSS-REFERENCE TO RELATED APPLICATIONS

This application is the United States national phase of International Application No. PCT/EP2017/060999 filed May 9, 2017, and claims priority to German Patent Application No. 10 2016 108 513.8 filed May 9, 2016, the disclosures of which are hereby incorporated in their entirety by reference.

The invention relates to a system and to a method for cleaning a floor using at least one cleaning robot.

BACKGROUND OF THE INVENTION

Cleaning robots are known as independently moving and navigating robot units in the form of vacuuming robots, sweeping robots and mopping robots. For this purpose, such cleaning robots have electrically operated suction-fan units and/or electric motor powered brushes and/or bristle rollers and/or mopping elements, as well as a dust and dirt collection compartment.

FIELD OF THE INVENTION

Cleaning robots are able to independently clean dust and coarse material from hard floors, such as parquet floors, laminate floors, tiled floors or stone floors as well as textile floor coverings, by means of a suction air current and where required by means of a mechanical brush. Sweeping robots, on the other hand, clean purely mechanically by means of brushes and collection containers without using an air suction current. In the case of mopping robots, a mopping element is also included which is usually moved at high frequency and which takes up dirt from the floor by means of a detergent which is usually based on water.

At least one motor means for driving at least one of at least three wheels is provided to move the cleaning robot across a floor. Usually, two electric motors are provided which independently of one another drive two drive wheels, wherein a third idler wheel is provided to stabilize the cleaning robot.

In addition, known cleaning robots have at least one sensor, in particular a plurality of sensors, for observing the room surrounding the cleaning robot. The cleaning robot can detect the surrounding area by means of the sensors and the cleaning robot can largely navigate without making contact with any walls or objects.

The cleaning robot is supplied with electric power via rechargeable batteries for operating the electrical components, in particular the electric motors, the sensors and a control. A stationary base station connected to the household mains supply is assigned to the cleaning robot in order to charge the rechargeable batteries and in addition where necessary to also dispose of the dirt or rubbish collected in a container inside the appliance.

Cleaning robots locate the base station automatically, e.g. by means of radio guidance and/or light signal guidance or radio communication between the base station and the cleaning robot. The request to go to the base station can be effected automatically, thus e.g. by radio communication between the base station and the cleaning robot. The cleaning robot can equally go to the base station by itself depending on the filling level of the dirt container inside the appliance and/or depending on the charge state of the rechargeable batteries. Furthermore, the cleaning robot can automatically go to the base station after completing a task to be carried out, e.g. cleaning a specified floor area.

Cleaning robots have control means which control the previously described actions of the cleaning robot. The control means are designed as computer means having a data processing unit which control the actions of the cleaning robot by means of input signals and/or stored data.

The cleaning robots described can be programmed so that the cleaning robot carries out a cleaning operation at prespecified times. The cleaning robot can equally be started manually. In addition, it is possible to specify a certain area of the room in which a cleaning operation is to be carried out. This area of the room can be the whole travelable area of the room or only one part of it. Thus, the use of this cleaning robot can be controlled solely on the basis of data input by the user.

DESCRIPTION OF RELATED ART

A system comprising at least a cleaning robot, control means and communication means is known from US 2014/0207280 A1. The system is provided with stationary sensors as well as with sensors, which are arranged on the cleaning robot, and which display on a Smartphone a user's past occupancy profile for a room. Subsequently, a user can choose at which day which room has to be cleaned. The user is informed via the smartphone, before the cleaning robot begins to clean. By means of the smartphone, the amount of dirt accumulated by the cleaning robot, or the dirtiest room, which the cleaning robot cleaned, is displayed to the user.

Therefore, the invention is based on the technical problem of designing a system and a method for cleaning a floor with a cleaning robot more flexibly and with improved cleaning results.

SUMMARY OF THE INVENTION

The previously specified technical problem is solved according to the invention by a system mentioned at the outset by providing control means (i.e. a controller) for controlling the cleaning robot and by providing communication means for detecting at least one event with an increased soiling occurrence for at least one part of the floor, wherein the control means set the intensity of the use of the cleaning robot for cleaning at least one part of the floor depending on the intensity of at least one event with an increased soiling occurrence.

Hence, according to the invention it is proposed, independently of a set programming of the actions of the cleaning robot, to intensify the floor cleaning when certain events are identified by the communication means. If such events exist then the control means can additionally activate the cleaning robot, so that during or after an increased soiling occurrence the floor is cleaned possibly earlier than according to a prespecified time schedule.

There are various possibilities for detecting at least one event with an increased soiling occurrence.

For example, the communication means can identify an entry of an electronic calendar connectable to the communication means as an event with an increased soiling occurrence. To that end, preferably certain key terms, such as "party", "meal", "get-together", "meeting", "football", in particular in connection with "at home", "garden", "living room", etc., can be searched for in the at least one calendar. Such events are associated with increased soiling due to a more intensive use of the living area. The system can then, for example after a "party" "at home", set an additional cleaning operation by the cleaning robot, for example in the night still or the next morning, independently of or in coordination with a possibly programmed regular time schedule.

If an event with an increased soiling occurrence is determined, such as a party taking place in the living area, which requires an increased level of cleanliness of the living area, even before the event has started, then the cleaning robot can be activated to carry out an additional cleaning operation even before the event has started.

In addition, preferably the communication means can identify an item of weather information from a database as an event with an increased soiling occurrence. Current weather information in one or more weather databases is retrieved, for example in a network, in particular in the internet, for this purpose. In the weather data detected, key terms, such as "rain", "snow", "mud", "wind", "storm" can then be searched for, in order to identify events with an increased soiling occurrence. Weather reports, on the one hand, or seasons calendars can be used for this purpose.

For example, when using seasons calendars, a scheduled cleaning cycle can be shortened in seasons with an increased rainfall occurrence and lengthened in seasons with a lower rainfall occurrence.

In particular, the communication means can detect the duration or the intensity of a rainfall event as the intensity of events with an increased soiling occurrence. This is because rainfall events have the strongest influence on how quickly and intensively a dwelling becomes dirty.

Preferably, the communication means detect the number and/or the strength of the at least one event as the intensity of events with an increased soiling occurrence. If subsequently several events occur within a short period of time, then the control means can activate the cleaning robot for an additional cleaning operation after the last of the events and hence increase the intensity of the use of the cleaning robot in a sensible manner without generating too many uses of the cleaning robot.

If, on the other hand, several events are identified with a greater time interval, then the control means can activate the cleaning robot several times to carry out an additional cleaning operation. The intensity of the use of the cleaning robot is also increased in this way.

If, on the other hand, a single event with high intensity is identified, then the intensity of the next scheduled cleaning operation or an additional cleaning operation by the cleaning robot can be increased by means of a slower travel speed and/or by means of an increased number of cleaning cycles.

In addition, it is preferable for the control means to set the intensity of the use of the cleaning robot by changing the frequency and/or the intensity of the cleaning effect (suction power, rotations of the cleaning brushes). The frequency can mean the number of separate uses of the cleaning robot or the number of times a certain living area is travelled over during a use of the cleaning robot. The intensity of the cleaning can again be set by adjusting the travel speed and/or the cleaning power, in particular the suction power, of the cleaning robot. The intensity of the cleaning can also be increased for just one part of the living area, for example in the area of an entrance door or in the area of the living room in which a party has taken place.

The system can be designed such that the communication means with the data gathering are arranged in the cleaning robot and are connected to the control means, and such that the communication means are connected to a network by means of a wireless communication link. Hence, the cleaning robot has the entire data gathering and control itself on board. Therefore, such a system can be used autonomously to a great extent. The communication means can, for example, be integrated in the base station or in a separate device.

Alternatively, the communication means with the data gathering can be arranged outside the cleaning robot and connected to a network and the communication means can be connected to the control means by means of a wireless communication link. In this case, the system could have more than one cleaning robot, which are all provided with the information vital for the control via the same communication means.

The above disclosed technical problem is also solved by a method for cleaning a floor using a cleaning robot, in which at least one event with an increased soiling occurrence for at least one part of the floor is detected, and in which the intensity of the use of the cleaning robot for cleaning at least one part of the floor is set depending on the intensity of at least one event with an increased soiling occurrence.

This method and its subsequently described embodiments have the same properties and advantages as were previously described for the system. Reference is therefore made to the previous description.

The described method can be further developed by a sequence of actions,

- in which an entry of a calendar connectable to the communication means is identified as an event with an increased soiling occurrence and/or
- in which an item of weather information from a database is identified as an event with an increased soiling occurrence and/or
- in which the duration or the intensity of a rainfall event is detected as the intensity of events with an increased soiling occurrence and/or
- in which the number and/or the strength of the at least one event is detected as the intensity of events with an increased soiling occurrence and/or
- in which the intensity of the use of the cleaning robot is set by changing the frequency and/or the intensity of the cleaning.

BRIEF DESCRIPTION OF THE DRAWINGS

The invention is explained below by means of exemplary embodiments with reference to the figures.

DESCRIPTION OF THE INVENTION

Figure 1:
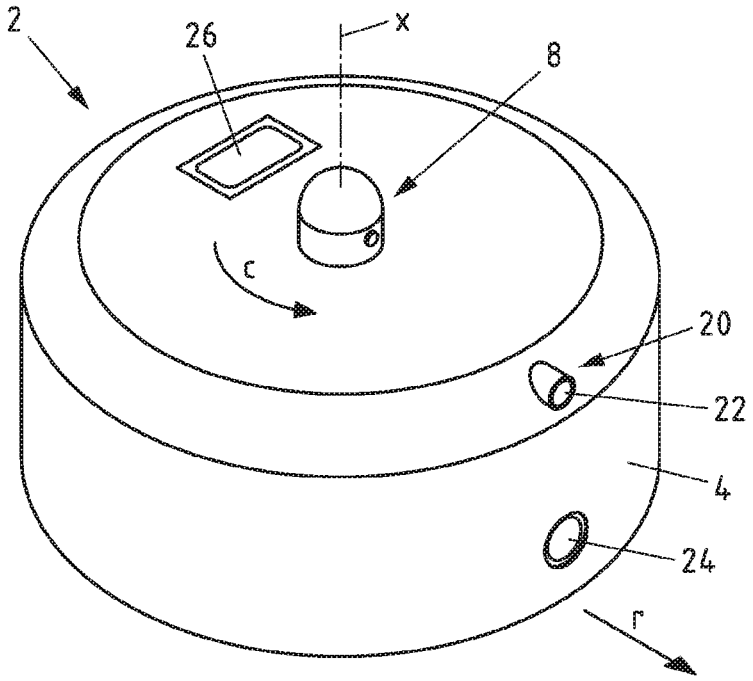
FIG. 1 shows an exemplary embodiment of a cleaning robot according to the invention in a perspective view from above.
Figure 2:
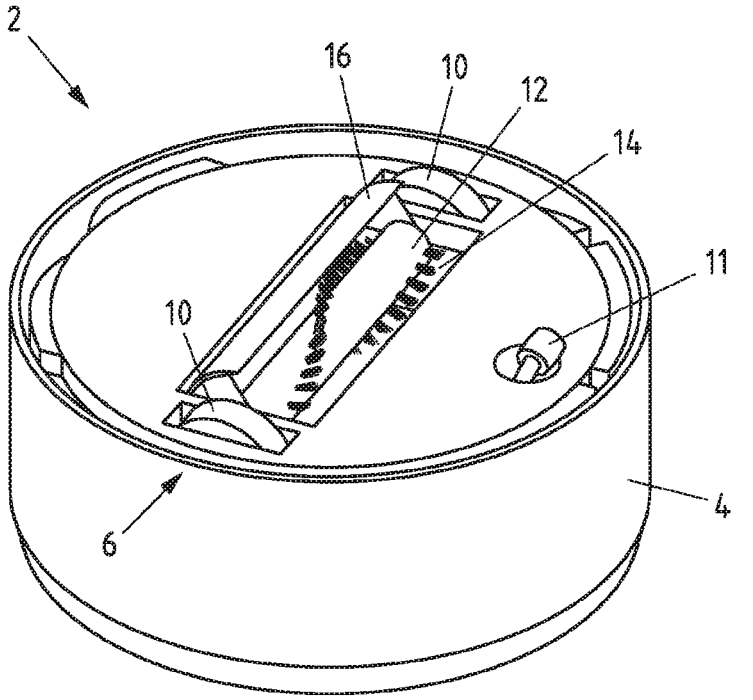
FIG. 2 shows the cleaning robot illustrated in FIG. 1 in a perspective view from below and FIG. 3 shows a system according to the invention for cleaning a floor.

A cleaning robot according to the invention in the form of a vacuuming robot 2 is illustrated in FIGS. 1 and 2. The vacuuming robot 2 has a housing 4, running gear 6 arranged on the underside of the housing 4, a sensor system 8 for detecting the area surrounding the housing 4 and a control for automatically driving the running gear 6.

The running gear 6 is arranged on the underside of the housing 4 and faces the floor area to be cleaned. The running gear 6 has two electric motor powered drive wheels 10 and an idler wheel 11, so that a three-point support of the floor cleaning robot 2 is obtained on the floor area to be cleaned. By controlling the two drive wheels 10 differently, the vacuuming robot 2 can be moved in any direction, wherein a forward movement in the direction of the arrow r is carried out according to FIG. 1. A rotation on the spot and a backward movement in the opposite direction of the arrow r are equally possible.

As emerges from FIG. 2 in particular, on the underside of the housing 4 an electric motor powered brush 12 protruding beyond the bottom edge is arranged inside a suction opening 14. In addition, a suction fan motor (not illustrated) is provided which is also electrically powered. A dustpan-like ramp 16 is also provided, via which the brushed-up dirt particles are conveyed into a container-like receptacle (not illustrated).

The electric power is supplied to the individual components of the vacuuming robot 2, i.e. to the electric motor of the of the drive wheels 10, to the electric drive of the brush 12, to the suction fan and to the further electronics of the control by means of a rechargeable battery (not illustrated).

In order to be able to identify the surroundings, room boundaries and possible obstacles and in order in particular to prevent the vacuuming robot 2 from getting stuck, the sensor system 8, which has already been mentioned, is provided which is designed as a sensory obstacle detection system. This consists of an optical transmitting unit and an optical receiver unit which are both integrated in the sensor system 8 illustrated in FIG. 1. In this exemplary embodiment, the sensor system 8 is arranged rotatably about a vertical axis x of the housing 4, as is illustrated with the arrow c in FIG. 1. Further sensors 20, 22 and 26 are present which are designed as ultrasonic sensors and/or infrared sensors. In addition, a display 26 is provided which displays information for the user and, where required, serves as an input assistance for operation commands.

Figure 3:
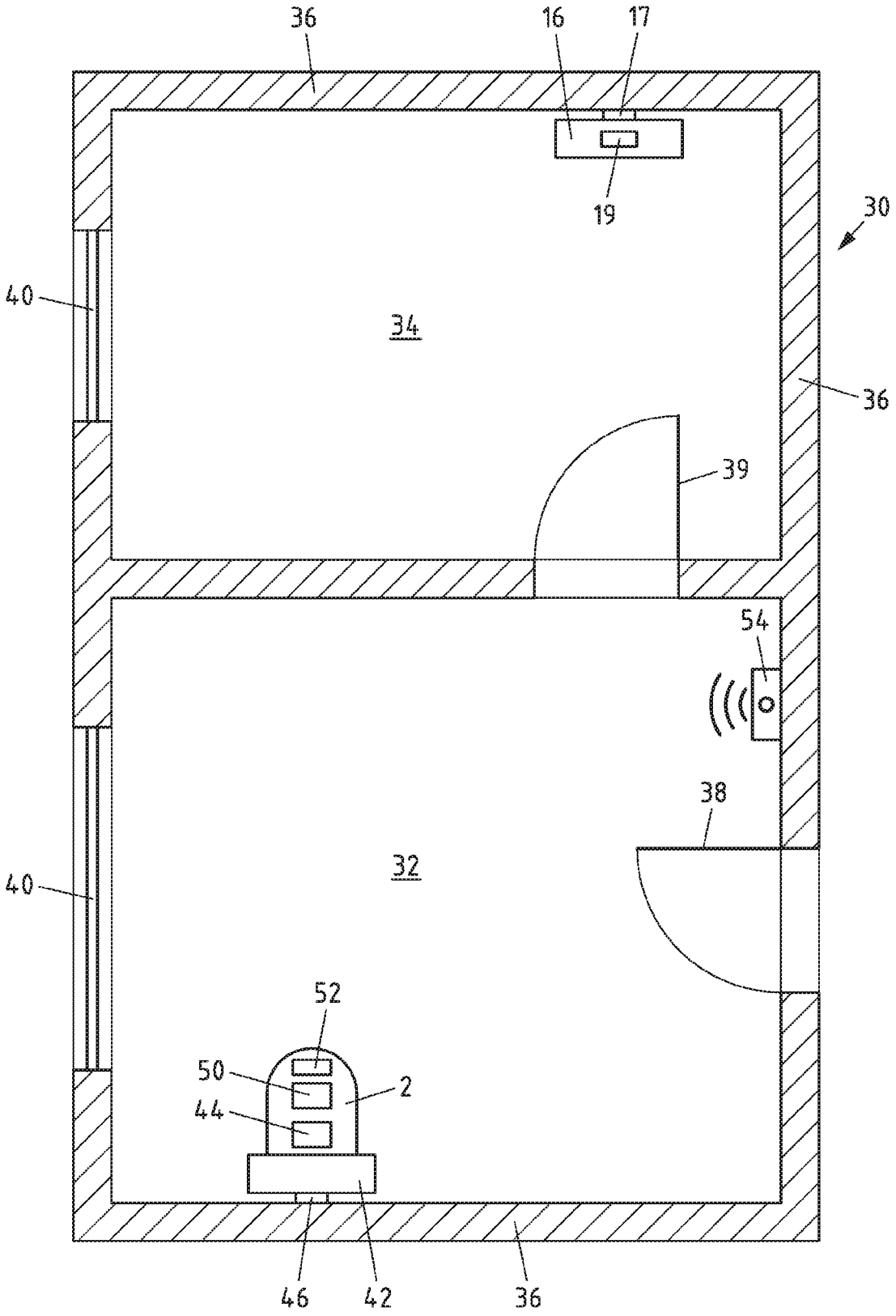

FIG. 3 now shows a system according to the invention for a cleaning a floor having at least one cleaning robot 2, which can be designed as a vacuuming robot for example as illustrated in FIGS. 1 and 2, in an exemplary environment of a dwelling 30 which has two rooms 32 and 34. FIG. 3 also shows a floor plan of the dwelling with walls 36, entrance door 38 and room door 39 and window 40.

A vacuuming robot 2 is located in the room 32 and is attached to a base station 42 for charging with mains voltage at least one battery 44 provided in the vacuuming robot 2. The base station 42 is positioned in the room 32 and is attached to an electrical socket 46.

The vacuuming robot 2 has control means 50 (i.e. a controller 50) for controlling the vacuuming robot 2 and communication means 52 for detecting at least one event with an increased soiling occurrence for at least one part of the floor. The communication means 52 have a transmitting and receiving device for wireless communication with a transmitting and receiving device arranged in the room 32 as communication means 54. The wireless communication takes place according to a standardized procedure such as WLAN or Bluetooth.

In addition, the communication means 52 can also have a mobile radio device, so that in this case no communication means 54 are required.

The communication means 52 and, where required, 54 can be connected to a local or external network, in particular to the internet, by means of a cable connection or wirelessly, in order to detect information about events with an increased soiling occurrence.

The control means 50 are connected to the communication means 52 and receive data regarding one of more events via this connection. The control means 50 set the intensity of the use of the vacuuming robot 2 for cleaning at least one part of the floor depending on the intensity of at least one event with an increased soiling occurrence.

An example of events consists in the communication means 52 identifying an entry in a calendar connectable to the communication means 52 and, where required, 54 as an event with an increased soiling occurrence. This calendar can be the personal calendar of a person living in the dwelling, a so-called family calendar for several people or some other calendar. The manner of managing the calendar can be carried out by different programs or service providers.

The communication means 52 searches for prespecified key terms, such as "party", "meal", "get-together", "meeting", "football", possibly in combination with the terms "at home", "garden", "living room" in the calendar entries. On discovering one of these terms or combinations of terms, the communication means 52 determine an event with an increased soiling occurrence. This is because the corresponding calendar entries indicate an intensive use of the dwelling or of parts of the dwelling.

In the case of the events mentioned, a higher level of cleanliness within the dwelling is also important, with the result that the control means 50 can also activate the vacuuming robot 2 to carry out an additional cleaning operation before the event.

Additionally or alternatively, the communication means 52 can identify an item of weather information from a database as an event with an increased soiling occurrence. The communication means 52 access weather data from the network, preferably from the internet, via the wireless link for this purpose.

The communication means 52 searches for prespecified key terms in the weather data and detects the local weather events in the coming period of time. The terms "rain", "snow", "mud", "wind", "storm" or combinations of these terms can be used as key terms. In addition, at least one seasons calendar can also be used, in order to detect general weather trends.

The communication means 52 can in particular detect the duration or the intensity of a rainfall event as the intensity of events with an increased soiling occurrence from the described identified weather data. This is because rain or snow events in particular result in increased soiling in the course of normal use of the dwelling.

The communication means 52 can additionally or alternatively detect the number and/or the strength of weather events as the intensity of events with an increased soiling occurrence. This information also serves to be able to estimate the degree of soiling of the dwelling.

The above described control means 50 set the intensity of the use of the vacuuming robot 2 by changing the frequency and/or the intensity of the cleaning depending on the data of the detected events. Hence, the dwelling 30 can be cleaned more often and/or more intensively by means of the vacuuming robot 2 in addition to an entered, planned time schedule. If no time schedule is entered, then the control can plan and carry out the cleaning of the dwelling 30 independently.

Furthermore, the spatial extent of the cleaning of the dwelling 30 can also be set by the events data. If, for example, it is detected that an event is going to take place in the living room (room 32 in FIG. 3), in which several people are visiting, then the control 50 can get the vacuuming robot 2 to, possibly additionally, clean only the room 32 and not the room 30 (bedroom) after this event. If, on the other hand, for example a rain event is determined, then the control 50 can activate the vacuuming robot 2 in such a way that the area in front of the entrance door 38 is cleaned more intensively than other areas of the dwelling 30.

The system was previously described such that the communication means 52 are arranged in the vacuuming robot 2 and connected to the control means 50 and such that the communication means 52 are connected by means of a wireless communication link to a network via the device 54. As a result, the vacuuming robot 2 is autonomous with regard to data retrieval, evaluation and control.

In addition, it is also possible for the communication means 54 to be arranged outside the vacuuming robot 2 and connected to a network and for the communication means 54 to be connected via the communication means 52 to the control means 50 by means of a wireless communication link. In this case, the data retrieval takes place outside the vacuuming robot 2. Such a system then offers the possibility of providing more than one vacuuming robot 2 with the events data and of organizing a larger living area than is illustrated in FIG. 3.

The invention claimed is:

1. A system for cleaning a floor, comprising:

at least one cleaning robot, a controller for the at least one cleaning robot, wherein a communication means is configured to detect at least one event with an increased soiling occurrence for at least one part of the floor, and the controller is configured to set an intensity of use of the cleaning robot for cleaning at least one part of the floor depending on an intensity of the at least one event with an increased soiling occurrence.

2. The system according to claim 1, wherein the communication means identifies an entry of a calendar connectable to the communication means as an event with an increased soiling occurrence.

3. The system according to claim 1, wherein the communication means identifies an item of weather information from a database as an event with an increased soiling occurrence.

4. The system according to claim 3, wherein the communication means detects a duration or an intensity of a rainfall event as the intensity of events with an increased soiling occurrence.

5. The system according to claim 3, wherein the communication means detects a number and/or a strength of at least one weather event as the intensity of events with an increased soiling occurrence.

6. The system according to claim 1, wherein the controller sets the intensity of use of the cleaning robot by changing the frequency and/or the intensity of the cleaning.

7. The system according to claim 1, wherein the communication means are arranged in the cleaning robot and are connected to the controller, and wherein the communication means are connected to a network by means of a wireless communication link.

8. The system according to claim 1, wherein the communication means are arranged outside the cleaning robot and are connected to a network, and wherein the communication means are connected to the controller by means of a wireless communication link.

9. A method for cleaning a floor using a cleaning robot, comprising detecting at least one event with an increased soiling occurrence for at least one part of the floor, and setting an intensity of use of the cleaning robot for cleaning at least one part of the floor depending on the intensity of at least one event with an increased soiling occurrence.

10. The method according to claim 9, further comprising identifying an entry of a calendar connectable to a communication means as an event with an increased soiling occurrence.

11. The method according to claim 9, further comprising identifying an item of weather information from a database as an event with an increased soiling occurrence.

12. The method according to claim 11, further comprising detecting a duration or an intensity of a rainfall event as the intensity of events with an increased soiling occurrence.

13. The method according to claim 9, further comprising detecting a number and/or a strength of the at least one event as the intensity of events with an increased soiling occurrence.

14. The method according to claim 9, further comprising setting the intensity of use of the cleaning robot by changing the frequency and/or the intensity of the cleaning.

* * * * *